United States Patent [19]

Aigner

[11] Patent Number: 4,899,477

[45] Date of Patent: Feb. 13, 1990

[54] HAND-HELD AUTOMATIC FIREARM

[75] Inventor: Friedrich Aigner, St. Valentin, Austria

[73] Assignee: Steyr-Daimler-Puch AG, Vienna, Austria

[21] Appl. No.: 241,855

[22] Filed: Sep. 8, 1988

[30] Foreign Application Priority Data

Sep. 22, 1987 [AT] Austria ..... 2394/87

[51] Int. Cl.[4] ..... F41C 15/00

[52] U.S. Cl. ..... 42/25; 89/154

[58] Field of Search ..... 89/154; 42/25, 70.08, 42/69.03

[56] References Cited

U.S. PATENT DOCUMENTS

| | | | |
|---|---|---|---|
| 730,870 | 6/1903 | Browning | 89/154 |
| 1,202,017 | 10/1916 | Barnes | 42/69.03 |
| 1,860,157 | 5/1932 | Payne | 89/154 |
| 2,324,125 | 7/1943 | Horn et al. | 42/69.03 |
| 2,535,156 | 12/1950 | Pastore et al. | 42/69.03 |
| 3,060,809 | 10/1962 | Tschumi | 42/69.03 |
| 3,394,482 | 7/1968 | Badali | 42/25 |
| 3,561,148 | 2/1971 | Maillard | 42/25 |
| 4,048,901 | 9/1977 | Ghisoni | 42/75.03 |
| 4,438,678 | 3/1984 | Ruger | 89/138 |
| 4,522,106 | 6/1985 | Sullivan | 42/69.03 |
| 4,627,184 | 12/1986 | Ruger et al. | 42/75.03 |

FOREIGN PATENT DOCUMENTS

| | | | |
|---|---|---|---|
| 999514 | 7/1965 | United Kingdom | 89/154 |

*Primary Examiner*—Deborah L. Kyle
*Assistant Examiner*—Stephen Johnson
*Attorney, Agent, or Firm*—Marmorek, Guttman & Rubenstein

[57] ABSTRACT

A hand-held automatic firearm comprises a breechblock, which is longitudinally slidably guided and at its forward end has a standing face for engaging a cartridge, a hammer, which is adapted to be cocked by the breechblock as it recoils, a sustained-fire lever, which is controlled by the breechblock and catches the hammer as the breechblock advances, and an ejector, which is movable relative to the breechblock and ejects the cartridge case as the breechblock recoils. In order to provide a compact and inexpensive design, the sustained-fire lever comprises a follower arm, which protrudes toward the barrel and extends into a track groove, which is formed in the breechblock and opens into the standing face, and the follower arm has a free end, which acts as an ejector.

3 Claims, 2 Drawing Sheets

HAND-HELD AUTOMATIC FIREARM

BACKGROUND OF THE INVENTION

1. Field of the Invention

This invention relates to a hand-held automatic firearm comprising a breechblock, which is longitudinally slidably guided and at its forward end has a standing face for engaging a cartridge, a hammer, which is adapted to be cocked by the breechblock as it recoils, a sustained-fire lever, which is controlled by the breechblock and catches the hammer as the breechblock advances, and an ejector, which is movable relative to the breechblock and ejects the cartridge case as the breechblock recoils.

2. Description of the Prior Art

Such hand-held firearms comprising a trigger mechanism including a firing hammer can be operated for a sustained fire in such a manner that the hammer which has been cocked by the recoiling breechblock is locked by means of the sustained-fire lever until the breechblock has been advanced and locked, whereafter the sustained-fire lever under the control of the breechblock releases the hammer, which then strikes forward and by means of a firing pin fires the cartridge. Only when the trigger which has been pulled is released will the hammer be caught independently of the sustained-fire lever by a disconnector lever, which cooperates with the release lever proper so that the burst of fire is interrupted. In case of single shots, the release lever and the disconnector lever are operated after each shot to override the action of the sustained-fire lever. By the powder gases which force the empty cartridge case from the cartridge chamber against the standing face of the breechblock the latter is thrown back so that the empty cartridge case will recoil with the breechblock. By an ejector which engages the cartridge case near the standing face, the recoiling cartridge case is tilted away from the standing face and is ejected out of the firearm through a suitable ejecting opening. Precisely manufactured parts have previously been required to ensure a proper cooperation of the breechblock with the sustained-fire lever and with the separately provided ejector and such parts have involved a substantial structural expenditure and particularly a relatively large bulk.

SUMMARY OF THE INVENTION

It is an object of the invention to eliminate these disadvantages and to provide a hand-held firearm which is of the kind described first hereinbefore and which has a particularly economical and space-saving design as regards the sustained-fire lever and the ejector.

That object is accomplished in accordance with the invention in that the sustained-fire lever comprises a follower arm, which protrudes toward the barrel and extends into a track groove, which is formed in the breechblock and opens into the standing face, and the follower arm has a free end, which acts as an ejector. The combination of the sustained-fire lever and the ejector in a single component is a surprisingly simple measure of design, which has the result that the breechblock region of the firearm is much more compact, that the structural expenditure is greatly reduced and that a functionally reliable operation of the sustained-fire lever and of the ejector will be ensured even if said parts have been manufactured with relatively large tolerances.

In a particularly desirable design within the scope of the invention the sustained-fire lever is disposed laterally of the hammer and is pivoted on a vertical axis and the track groove cooperating with the follower arm is laterally disposed in the breechblock. Because the sustained-fire lever is laterally disposed, the overall height of the firearm can be reduced so that the handling of the firearm will be facilitated. Besides, the cartridge case can be laterally ejected, as is desirable. Moreover, the lateral pivotal movement of the sustained-fire lever permits a quick and reliable locking of the hammer.

If in such an arrangement the pivotal axis of the sustained-fire lever is disposed behind the axis of the hammer in the shooting direction and the sustained fire lever is fitted on the pivot for the hammer with an angular play and is biased toward the hammer by a coil spring, which surrounds the pivot for the hammer, the follower lever will properly be guided in its movement and the arrangement and mounting of the spring for biasing the sustained-fire lever will be particularly inexpensive.

DETAILED DESCRIPTION OF THE PREFERRED EMBODIMENT

Figure 1:
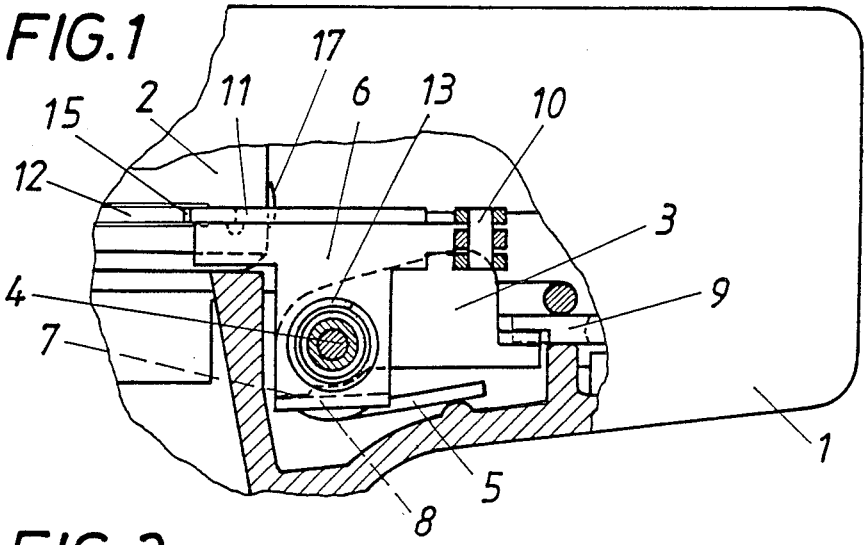
FIG. 1 is a fragmentary vertical sectional view taken on line I—I in FIG. 2 and showing a part of a hand-held firearm embodying the invention.

An illustrative embodiment of the invention is strictly diagrammatically shown in the drawing.

A hand-held automatic firearm 1 is merely diagrammatically indicated on the drawing and comprises a barrel 18, a receiver 1*a*, a breechblock 2, which is guided for a longitudinal displacement, and a firing hammer 3, which is adapted to be cocked by the breechblock as it recoils. The hammer 3 is pivotally movable against the force of a hammer spring 5 about a transverse horizontal pivot 4 and when it has swung back and the spring 5 is cocked the hammer 3 will be locked in that a hammer catch 8 of a breechblock-controlled sustained-fire lever 6 engages an extension 7 of the hammer from below. A release lever and a disconnector lever 9 are connected to the trigger by means which are not shown and can be used to retain the hammer 3 independently of the sustained-fire lever 6 so that the firearm can be used for single shots and for sustained fire.

The sustained-fire lever 6 is disposed laterally of the hammer 3 and is pivoted on an upright pivot 10, which in the shooting direction is disposed behind the pivot 4 for the hammer. The sustained-fire lever 6 comprises a follower arm 11, which protrudes toward the barrel and extends into a track groove 12 in the peripheral surface of the breechblock 2. The sustained-fire lever 6 is fitted with an angular play on th e pivot 4 for the hammer and is biased by a coil spring 13, which surrounds the pivot 4 for the hammer. That arrangement ensures a proper guidance and mounting of the sustained-fire lever 6 and the spring 13.

As the track groove 12 extends as far as to the standing face 14 at the forward end of the breechblock, the follower arm 11 which is guided in the track groove 12 will move to a position at the standing face as the breechblock recoils and the free end 15 of the follower arm 11 can then act as an ejector on the cartridge case 16.

Figure 2:
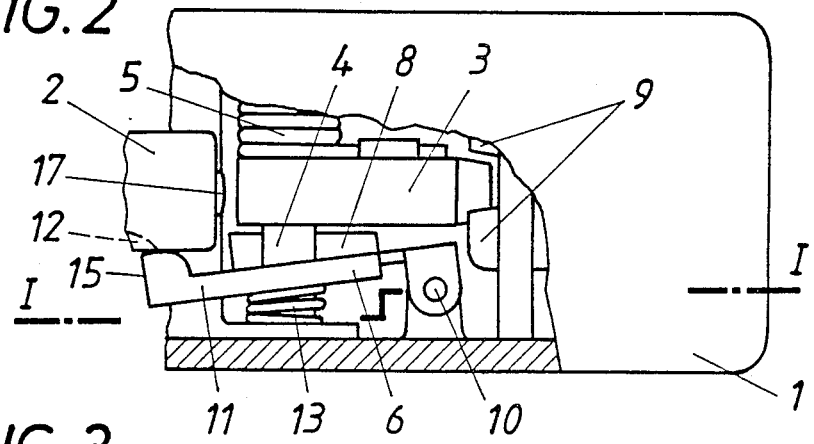
FIGS. 2 and 3 are top plan views showing the same part of the firearm partly in section with the breechblock in its foremost and rearmost positions, respectively.
Figure 3:
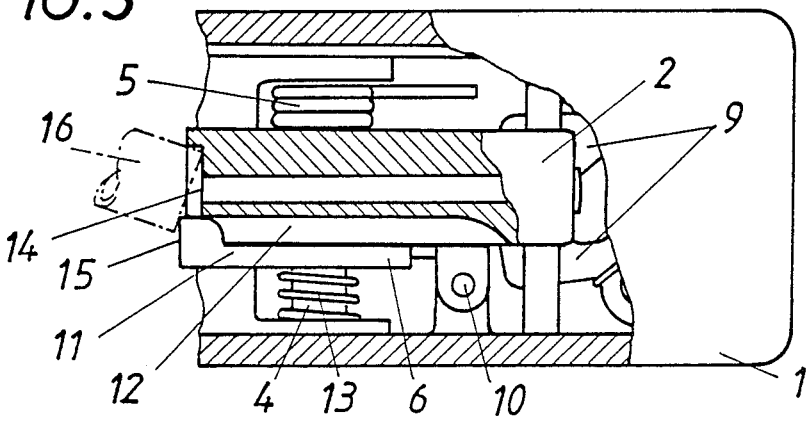
Figure 1A:
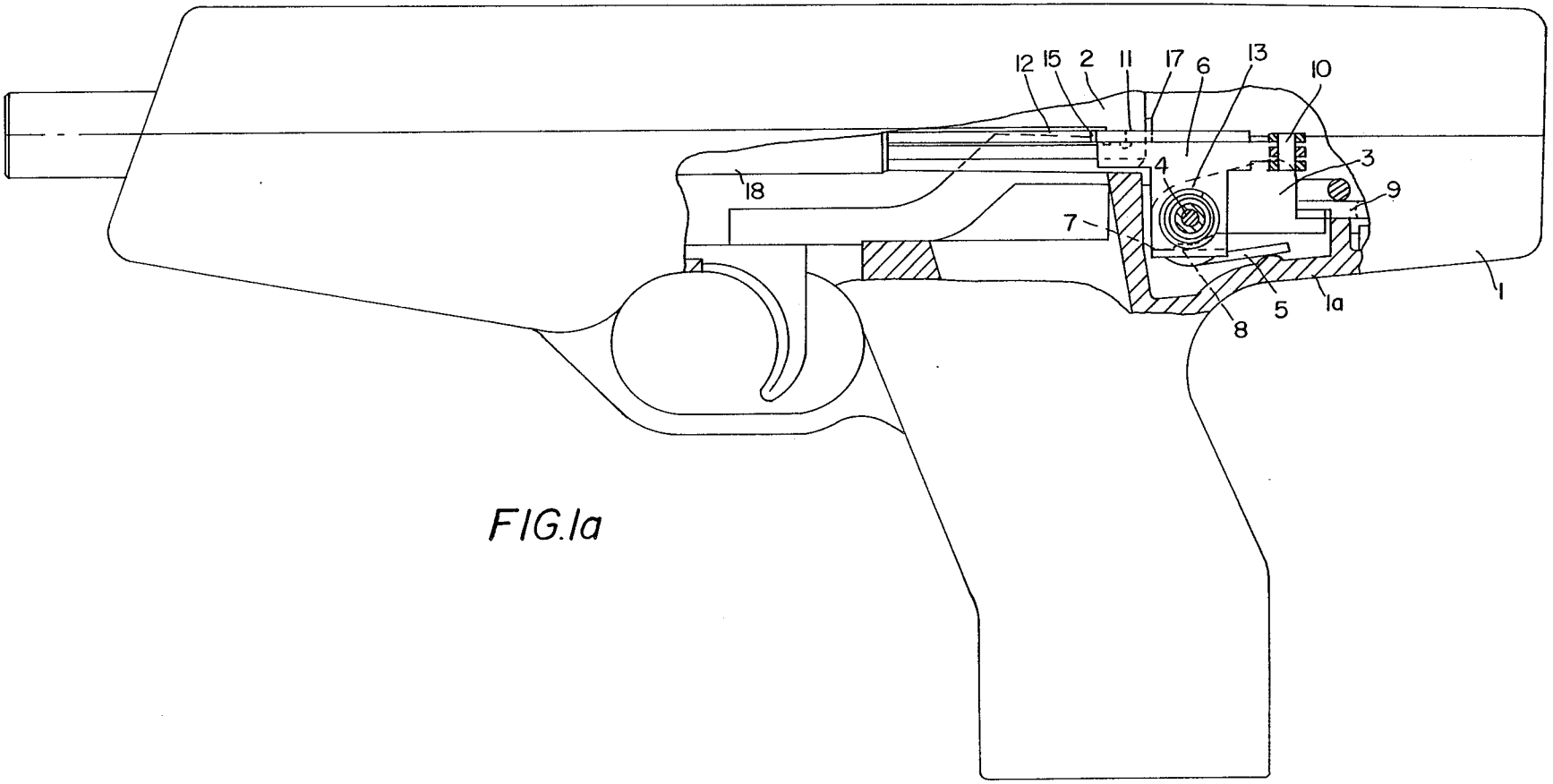
FIG. 1*a* is a side view, partly in section, showing a handheld firearm embodying the invention.

In the position shown in FIG. 2 the firearm 1 is ready to fire. The breechblock 2 is in its foremost position and the hammer 3 is cocked and has been caught by means of the release lever 9. Owing to the configuration of the track groove the sustained-fire lever 6 has been swung out to a position in which the hammer catch 8 of the lever 6 has already released the hammer 3. Upon the pulling of the trigger, the hammer 3 is released also by the release lever 9 so that the hammer 3 strikes forwardly and by means of the firing pin 17 fires the cartridge. The powder gases force back the cartridge case and the breechblock 2, which as it recoils cocks the hammer 3 whereas the free end 15 of the follower arm 11 laterally ejects the empty cartridge case 16. Owing to the relative movement between the breechblock 2 and the follower arm 11 the spring-loaded sustained-fire lever 6 is pivotally moved toward the hammer 3 so that the hammer catch 8 engages the hammer extension 7 from below and locks the hammer against a reverse pivotal movement. Only as the breechblock 2 advances does it impart to the sustained-fire lever 6 another outward pivotal movement so that the hammer 3 is released and in dependence on whether the firearm is in condition for sustained fire or for single shots will either strike forwardly again or will be caught by the release lever and/or the disconnector lever 9.

Because the sustained-fire lever and the ejector are combined in a functional unit and the sustained-fire lever is laterally disposed, the design of the firearm is greatly simplified and the bulk of the firearm is greatly decreased. Besides, the firearm can be manufactured more economically and is more reliable in operation.

I claim:

1. A handheld automatic firearm comprising a receiver, a barrel carried by said receiver, said barrel having a forward end, and a rear end disposed in said receiver, a breechblock, which is disposed in said receiver, is axially aligned with said barrel, and is slidably mounted in said receiver for axial reciprocating movement forwardly into engagement with said rear end of said barrel and rearwardly away from said rear end of said barrel to a rearmost position, said breechblock having a forward end formed with a standing face for engagement with a cartridge disposed in said barrel at said rear end thereof;

said breechblock having a peripheral surface, said peripheral surface being formed with a generally axially extending track groove which opens into said standing face, a hammer, which is pivoted to said receiver and is cocked by said breechblock as said breechblock moves rearwardly, a hammer spring opposing movement of said hammer as said hammer is cocked, said hammer spring tending to impart to said hammer a forward pivotal movement for firing a cartridge disposed in said barrel at said rear end thereof, a dual function sustained-fire and ejector lever which is pivotally mounted in said receiver and is responsive to said reciprocating movement of said breechblock, said dual function sustained-fire and ejector lever catching said hammer to prevent forward pivotal movement and thereafter releasing said hammer for forward pivotal movement during said reciprocating movement of said breechblock, said dual function sustained-fire and ejector lever comprising a follower arm extending into said track groove and riding therein during said reciprocating movement of said breechblock, said follower arm including a free end portion which protrudes forwardly beyond said standing face when said breechblock is in said rearmost position thereby to eject an empty cartridge case after each discharge of a cartridge.

2. The firearm set forth in claim 1 in which said hammer is pivoted to said receiver on a transverse horizontal axis, wherein said dual function sustained-fire and ejector lever is pivoted to said receiver on a vertical axis and said track groove is formed in a laterally disposed portion of said peripheral surface of said breechblock.

3. The firearm set forth in claim 2, wherein said vertical axis is disposed behind said horizontal axis, said vertical axis is defined by a first pivot, said dual function sustained-fire and ejector lever is fitted on said first pivot with limited angular play of said dual function sustained-fire and ejector lever about said first pivot, said horizontal axis is defined by a second pivot, and a coil spring is provided, which surrounds said second pivot and urges said dual function sustained-fire and ejector lever toward said hammer.

* * * * *